US011845624B2

(12) United States Patent
Chike et al.

(10) Patent No.: US 11,845,624 B2
(45) Date of Patent: Dec. 19, 2023

(54) CONVEYING DEVICE AND LIQUID DISCHARGE APPARATUS

(71) Applicants: Kohei Chike, Kanagawa (JP); Toshihiro Nakagaki, Ibaraki (JP)

(72) Inventors: Kohei Chike, Kanagawa (JP); Toshihiro Nakagaki, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 196 days.

(21) Appl. No.: 17/530,740

(22) Filed: Nov. 19, 2021

(65) Prior Publication Data

US 2022/0162030 A1 May 26, 2022

(30) Foreign Application Priority Data

Nov. 24, 2020 (JP) ..... 2020-194690
Nov. 15, 2021 (JP) ..... 2021-185958

(51) Int. Cl.
*G03G 15/00* (2006.01)
*B65H 29/00* (2006.01)
(Continued)

(52) U.S. Cl.
CPC ..... *B65H 29/62* (2013.01); *B41F 21/05* (2013.01); *B41F 21/10* (2013.01); *B41J 11/006* (2013.01);
(Continued)

(58) Field of Classification Search
CPC ..... G03G 15/5012; G03G 15/70; G03G 2215/00552; B41J 11/006; B41J 13/0027; B65H 7/20; B65H 43/04; B65H 2601/11; B65H 2801/03; B65H 2801/06; B65H 29/62; B65H 29/68; B65H 2801/21; B41P 2213/71; B41P 2233/20; B41F 21/05; B41F 21/10
(Continued)

(56) References Cited

U.S. PATENT DOCUMENTS 2,824,457 A * 2/1958 Norton ..... B41F 13/008 101/247
4,836,112 A * 6/1989 Moore ..... B41F 13/0008 101/248
(Continued)

FOREIGN PATENT DOCUMENTS

EP 3287285 A1 * 2/2018 ..... B41J 11/006
JP 2017-019172 1/2017

*Primary Examiner* — Robert B Beatty
(74) *Attorney, Agent, or Firm* — Duft & Bornsen, PC

(57) ABSTRACT

A conveying device includes a rotating carrier, an inlet rotary body, an outlet rotary body, a downstream conveyor, and an inching controller. The rotating carrier carries a sheet. The inlet rotary body transfers the sheet to the rotary carrier from upstream of the rotary carrier in a conveyance direction of the sheet. The outlet rotary body transfers the sheet to a downstream area from the rotary carrier in the conveyance direction. The downstream conveyor conveys the sheet downstream from the outlet rotary body in the conveyance direction. The inching controller performs an inching operation to convey the sheet on a conveyance path including at least the downstream conveyor. The inching controller causes at least the outlet rotary body and the downstream conveyor to perform a conveying operation in conjunction with each other in the inching operation.

7 Claims, 12 Drawing Sheets

(51) Int. Cl.

| | |
|---|---|
| ***B41F 21/00*** | (2006.01) |
| ***B41J 13/00*** | (2006.01) |
| ***B65H 29/62*** | (2006.01) |
| ***B41J 11/42*** | (2006.01) |
| ***B41F 21/05*** | (2006.01) |
| ***B41F 21/10*** | (2006.01) |
| ***B41J 11/00*** | (2006.01) |
| ***B65H 43/04*** | (2006.01) |
| ***B65H 29/68*** | (2006.01) |

(52) U.S. Cl.
CPC ..... *B41J 11/42* (2013.01); *B41J 13/0027* (2013.01); *B65H 29/68* (2013.01); *B65H 43/04* (2013.01); *G03G 15/5012* (2013.01); *B41P 2213/71* (2013.01); *B41P 2233/20* (2013.01); *B65H 2601/11* (2013.01); *B65H 2801/21* (2013.01); *G03G 2215/00552* (2013.01)

(58) Field of Classification Search
USPC ..... 399/19, 20; 347/16
See application file for complete search history.

(56) References Cited

U.S. PATENT DOCUMENTS

| | | | | |
|---|---|---|---|---|
| 2012/0074638 | A1 | 3/2012 | Nakagaki | |
| 2012/0218328 | A1* | 8/2012 | Hattori | B41J 11/0024 347/8 |
| 2013/0215181 | A1* | 8/2013 | Fujikura | B41J 11/0095 347/19 |
| 2013/0241146 | A1 | 9/2013 | Takai et al. | |
| 2013/0307893 | A1* | 11/2013 | Suda | B41J 2/01 347/104 |
| 2013/0320616 | A1 | 12/2013 | Nakagaki | |
| 2014/0327207 | A1 | 11/2014 | Nakagaki | |
| 2016/0114993 | A1 | 4/2016 | Nakagaki | |
| 2016/0152431 | A1 | 6/2016 | Maeda et al. | |
| 2016/0167410 | A1* | 6/2016 | Takada | B65H 7/14 347/16 |
| 2021/0163250 | A1 | 6/2021 | Nakagaki | |
| 2023/0037177 | A1* | 2/2023 | Chike | G03G 15/70 |
| 2023/0131241 | A1* | 4/2023 | Nakagaki | B65H 29/58 271/184 |

* cited by examiner

CONVEYING DEVICE AND LIQUID DISCHARGE APPARATUS

CROSS-REFERENCE TO RELATED APPLICATIONS

This patent application is based on and claims priority pursuant to 35 U.S.C. § 119(a) to Japanese Patent Application Nos. 2020-194690, filed on Nov. 24, 2020, and 2021-185958, filed on Nov. 15, 2021, in the Japan Patent Office, the entire disclosure of each of which is incorporated by reference herein.

BACKGROUND

Technical Field

Embodiments of the present disclosure relate to a conveying device and a liquid discharge apparatus.

Related Art

A conveying device is known as a device that conveys a sheet serving as a sheet-shaped medium. As an example of the conveying device, a configuration is also known in which a rotary conveyor such as a cylinder or a drum is provided with a gripping unit such as a gripper. The rotary conveyor is rotated with a sheet being gripped by the gripping unit, to convey the sheet. Further, a liquid discharge apparatus is known that includes a conveying device and discharges liquid onto a sheet conveyed by the conveying device. The liquid discharge apparatus discharges liquid onto the sheet conveyed by the rotation of a rotary conveyor, to form an image on the sheet.

In the above-described conveying device, if floating, wrinkles, or folds are generated in a sheet during conveyance, a conveyance failure of the sheet may occur. For this reason, an apparatus is known that stops conveyance of a sheet and ejects the subsequent sheet to a predetermined purging tray when a state in which a conveyance failure such as floating, wrinkling, or folding of the sheet occurs. In this specification, a state in which a sheet-shaped medium is not normally conveyed, such as floating, wrinkling, or folding of the medium, may be referred to simply as a "conveyance failure".

To cope with a conveyance failure of a sheet during conveyance, for example, an apparatus is known that includes a first conveying unit to convey a sheet to an image forming area, a second conveying unit not to pass the sheet through the image forming area, and a switching part disposed upstream of the image forming area and configured to guide a sheet determined as conveyance failure to the second conveying unit and guide a sheet determined as normal conveyance to the first conveying unit.

SUMMARY

According to an embodiment of the present disclosure, there is provided a conveying device that includes a rotating carrier, an inlet rotary body, an outlet rotary body, a downstream conveyor, and an inching controller. The rotating carrier carries a sheet. The inlet rotary body transfers the sheet to the rotary carrier from upstream of the rotary carrier in a conveyance direction of the sheet. The outlet rotary body transfers the sheet to a downstream area from the rotary carrier in the conveyance direction. The downstream conveyor conveys the sheet downstream from the outlet rotary body in the conveyance direction. The inching controller performs an inching operation to convey the sheet on a conveyance path including at least the downstream conveyor. The inching controller causes at least the outlet rotary body and the downstream conveyor to perform a conveying operation in conjunction with each other in the inching operation.

According to another embodiment of the present disclosure, there is provided a liquid discharge apparatus that includes the conveying device to convey the sheet and a liquid discharge device to discharge liquid onto the sheet conveyed by the conveying device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
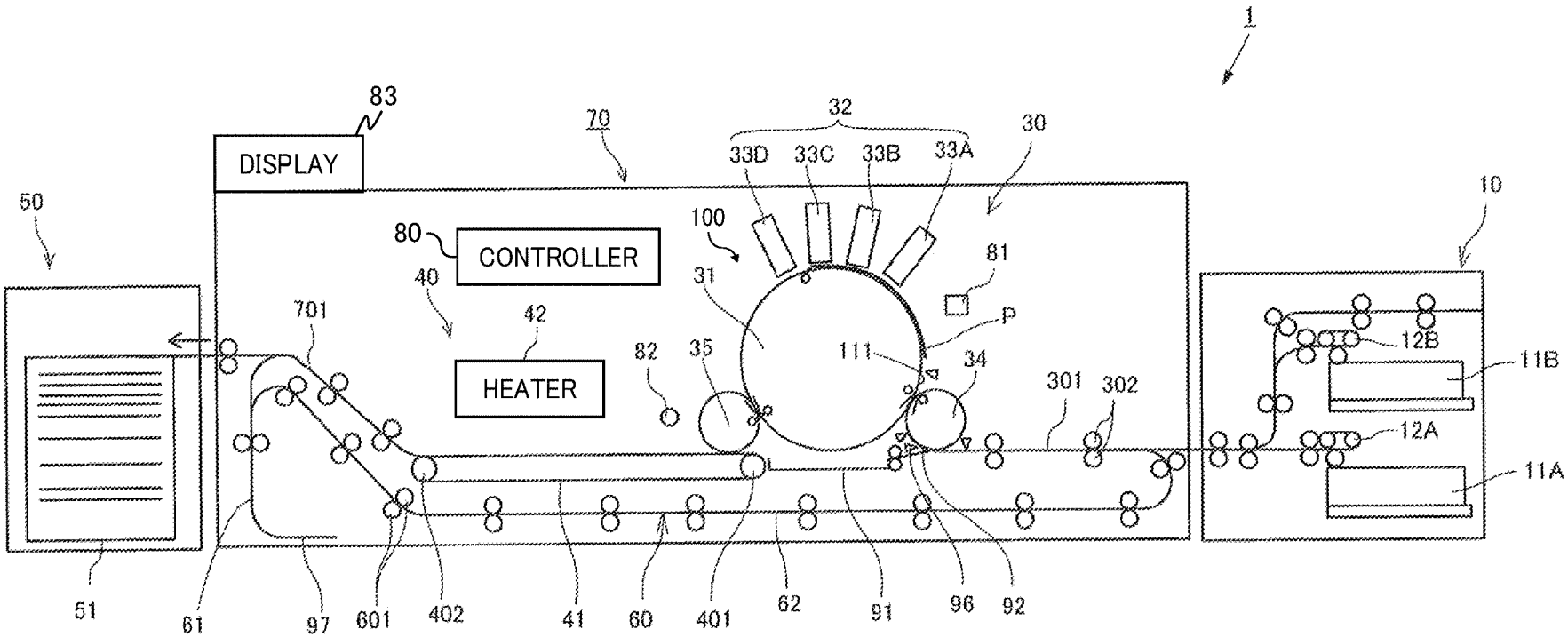
FIG. 1 is a schematic view of an image forming system serving as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
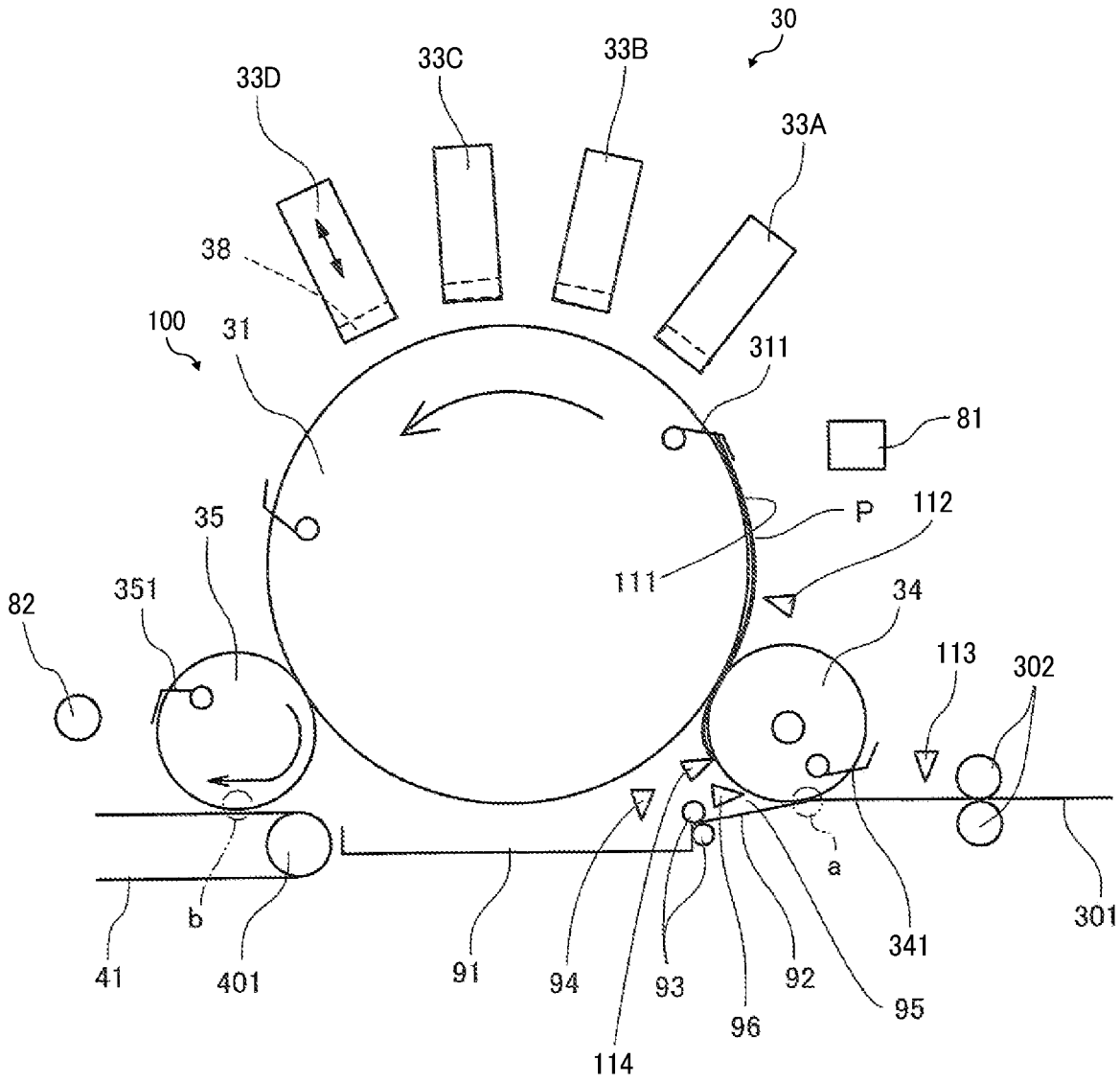
FIG. 2 is a schematic view of a conveying device of a liquid discharge apparatus according to a first embodiment of the present disclosure.
Figure 12:
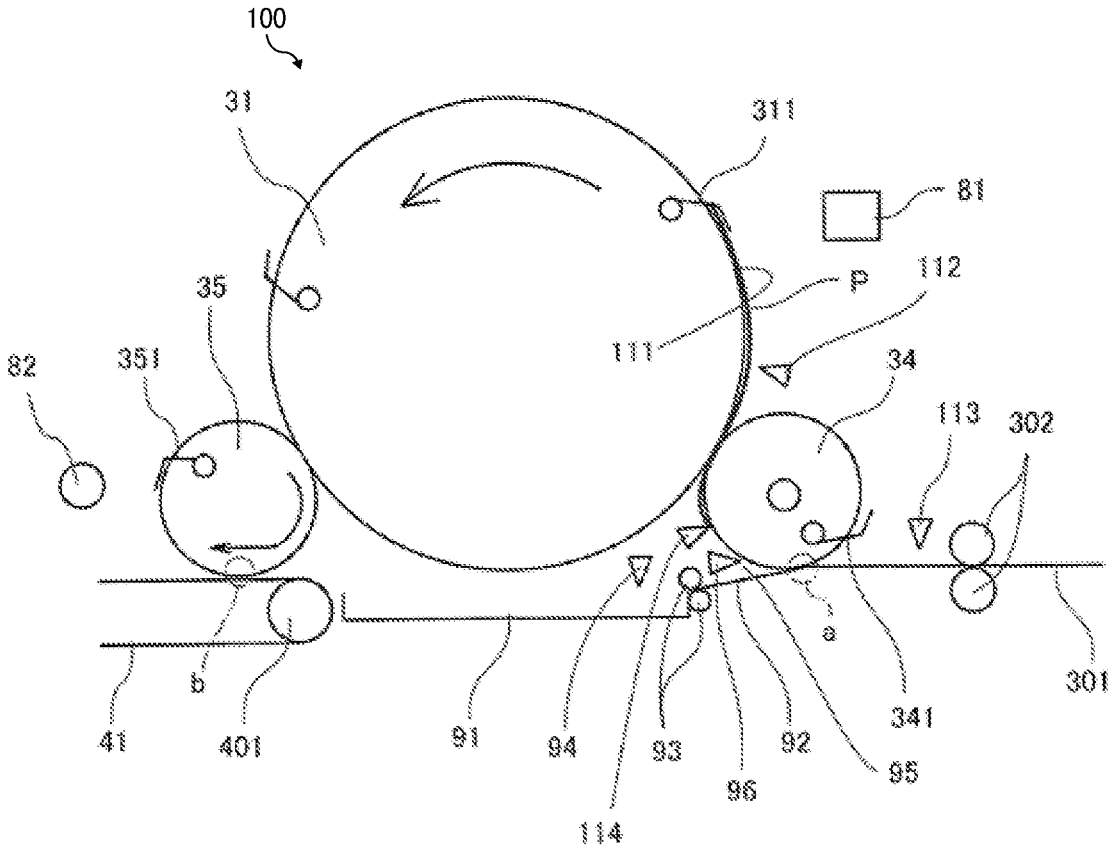
FIG. 12 is an enlarged view of a conveying device according to the first embodiment.

Hereinafter, embodiments of the present disclosure will be described with reference to the drawings. FIG. 1 is a schematic diagram illustrating a first embodiment of the present disclosure. FIG. 1 illustrates the overall configuration of an image forming system 1 serving as a liquid discharge apparatus that includes a drum-type conveying device 100 serving as a conveying device according to according to an embodiment of the present disclosure and discharges liquid onto a sheet-shaped medium conveyed by the drum-type conveying device 100. FIG. 2 is an enlarged view of a configuration of the drum-type conveying device 100 and its periphery in the image forming system 1. FIG. 12 is an enlarged view of the configuration of a main part of the drum-type conveying device 100. In FIG. 12, the configuration of, for example, the discharge unit 33 is omitted from FIG. 2.

The image forming system 1 includes a loading unit 10, a printing unit 70, and an ejection unit 50. The loading unit 10 conveys a sheet P as a sheet-shaped medium. The printing unit 70 discharges liquid onto the sheet P to form an image on the sheet P. The ejection unit 50 is the destination of conveyance of the sheet P on which the image has been formed.

The printing unit 70 is a printing apparatus and corresponds to a part of the configuration of the image forming system 1 serving as the liquid discharge apparatus according to the present embodiment. The printing unit 70 includes the drum-type conveying device 100 to convey the sheet P. The drum-type conveying device 100 conveys a sheet P to an image forming section 30, and the image forming section 30 performs printing on the sheet material P conveyed by the drum-type conveying device 100. Since the sheet P on which the image has been formed needs to be dried to fix the liquid on the sheet P, the drying section 40 serving as a fixing device is also included in the printing unit 70. The printing unit 70 also includes a duplex mechanism 60 for printing on both sides of the sheet. The printing unit 70 may include a pretreatment unit between the loading unit 10 and the printing unit 70. The pretreatment unit applies coating liquid such as pretreatment liquid onto the sheet P.

The printing unit 70 includes a controller 80 that controls the entire operation of the image forming system 1 and the drum-type conveying device 100. Details of the controller 80 are described below. In other embodiments, the controller 80 may be disposed in the drum-type conveying device 100, the loading unit 10, or the ejection unit 50.

In the image forming system 1, the image forming section 30 of the printing unit 70 applies liquid to the sheet P conveyed (supplied) from the loading unit 10 to perform printing, the drying section 40 dries (fixes) the liquid adhering to the sheet P, and then the sheet P is ejected to the ejection unit 50.

The loading unit 10 includes a lower loading tray 11A and an upper loading tray 11B, which are referred to collectively as loading trays 11, and a feeding device 12A and a feeding device 12B, which are referred to collectively as feeding devices 12. Each of the loading trays 11 stores a plurality of sheets P. Each of the feeding devices 12 separates and feeds the sheets P one by one from the loading trays 11 to supply the sheets P to the image forming section 30.

The image forming section 30 includes a liquid discharger 32 that discharges liquid toward a sheet P carried on a drum 31. The drum 31 is a carrying member serving as a rotating carrier that rotates while carrying the sheet P on a circumferential surface of the rotating carrier.

As illustrated in FIG. 2, the image forming section 30 includes the liquid discharger 32. The liquid discharger 32 includes discharge units 33 (discharge units 33A to 33D) to discharge liquids. The discharge unit 33 includes a liquid discharge head as a liquid discharge device. For example, the discharge unit 33A discharges a liquid of cyan (C), the discharge unit 33B discharges a liquid of magenta (M), the discharge unit 33C discharges a liquid of yellow (Y), and the discharge unit 33D discharges a liquid of black (K). In addition, a discharge unit to discharge a special liquid, that is, a liquid of spot color such as white, gold, or silver, can be used.

The image forming section 30 includes caps 38. Each of the caps 38 caps a discharge surface (nozzle surface) of corresponding one of the discharge units 33 of the liquid discharger 32. The discharge unit 33 reciprocates in the directions indicated by the double arrow in FIG. 2, and the cap 38 is movable in the axial direction of the drum 31. When the cap 38 caps the discharge surface of the discharge unit 33, the discharge unit 33 moves in a direction away from the circumferential surface of the drum 31, and the cap 38 enters below the discharge unit 33 (in other words, a position between the discharge unit 33 and the drum 31) to cap the discharge surface of the discharge unit 33.

The discharge operation of each of the discharge units 33 of the liquid discharger 32 is controlled by a drive signal corresponding to print data. When the sheet P borne on the drum 31 passes through the facing position facing the liquid discharger 32, the liquids of respective colors are discharged from the discharge units 33 toward the sheet P, and an image corresponding to the print data is formed (or printed) on the sheet P.

As illustrated in FIG. 12, the drum-type conveying device 100 further includes an inlet cylinder 34 and an outlet cylinder 35. The inlet cylinder 34, which is an example of an inlet rotary body, receives the sheet P fed from an upstream side (loading unit 10) and transfers the sheet P to the drum 31. The outlet cylinder 35, which is an example of an outlet rotary body, receives the sheet P conveyed from the drum 31 and transfers the sheet P to the drying section 40.

The inlet cylinder 34 is provided with a sheet gripper 341 as a gripping member on an outer peripheral portion of the inlet cylinder 34. The sheet gripper 341 is configured to grip, at a receipt position "a" (see FIG. 2), the leading end of the sheet P that is conveyed by, for example, a conveyance roller pair 302 through an loading path 301 serving as a conveyance path upstream from the inlet cylinder 34.

As the inlet cylinder 34 holding the leading end of the sheet P rotates, the sheet P is conveyed in the direction of rotation of the inlet cylinder 34. The conveyed sheet P is transferred to the drum 31 at a position where the drum 31 and the inlet cylinder 34 face each other.

When the sheet P is conveyed through the loading path 301, the printing unit 70 adjusts the conveyance speed of the sheet P by the conveyance roller pair 302 to adjust timing at which the leading end of the sheet P reaches the sheet gripper 341 of the inlet cylinder 34. Further, the printing unit 70 conveys the sheet P to a receipt position "a" while controlling a skew detector and a corrector to correct an inclination and a conveyance position of the sheet P in a direction perpendicular to the conveyance direction of the sheet P.

A sheet-length detector and a sheet-width detector are disposed at the loading path 301. The sheet-length detector detects the length of the sheet P in the conveyance direction of the sheet P. The sheet-width detector detects the width of the sheet P that is the length of the sheet P in a direction orthogonal to the conveyance direction. When the measured values are different for the set sheet size, the sheet-length detector and the sheet-width detector stop the printing operation, thus preventing liquid from being discharged onto the drum 31.

Sheet grippers 311 are disposed on a surface of the drum 31, and the leading end of the sheet P is gripped by one of the sheet grippers 311. The drum 31 has a plurality of suction holes dispersedly on the surface of the drum 31, and a suction device generates suction airflows directed inward from suction holes of the drum 31. The leading end of the sheet P delivered from the inlet cylinder 34 to the drum 31 is gripped by the sheet gripper 311 of the drum 31, is attracted by the suction airflows onto the circumferential surface of the drum 31 by the suction device, and is conveyed as the drum 21 rotates.

The sheet P on which the image has been formed is conveyed from the drum 31 to the outlet cylinder 35. The outlet cylinder 35 includes a sheet gripper 351 on an outer peripheral portion of the outlet cylinder 35. The sheet gripper 351 receives the sheet P fed from the drum 31. The sheet P is conveyed to the drying section 40 at a transfer position b illustrated in FIG. 2 as the outlet cylinder 35 rotates.

The drying section 40 includes a conveyance belt 41 and a heater 42. The conveyance belt 41 conveys the sheet P transferred from the outlet cylinder 35. The heater 42 heats the sheet P conveyed by the conveyance belt 41. The conveyance belt 41 is an endless belt and is stretched between a drive roller 401 and a driven roller 402.

The drying section 40 dries the liquid that has been adhered to the sheet P by the image forming section 30. Thus, a liquid component such as moisture in the liquid evaporates, and the colorant contained in the liquid is fixed on the sheet P. Additionally, curling of the sheet P is restrained. The sheet P that has passed through the drying section 40 is conveyed to the ejection unit 50 through an ejection path 701 or is sent to the duplex mechanism 60.

When the conveying operation of the sheet P is performed, the conveyance belt 41 conveys the sheet P received from the outlet cylinder 35 toward the heater 42, which is disposed downstream from the outlet cylinder 35 in the conveyance direction, so that the sheet P passes through the heater 42 at a predetermined conveying speed. The conveyance speed of the sheet material P by the conveyance belt 41 is set by the rotation speed of the drive roller 401. The rotation speed of the drive roller 401 is controlled by the controller 80.

When the leading end of the sheet P is separated from the outlet cylinder 35 and transferred to the conveyance belt 41, the rotation speed of the drive roller 401 is adjusted so that the conveyance belt 41 operates at a predetermined conveying speed. Further, when an inching operation described below is performed, the rotation speed of the drive roller 401 is also set in accordance with the rotation speed of the outlet cylinder 35. As a result, the sheet P transferred from the outlet cylinder 35 to the conveyance belt 41 during the inching operation is conveyed downstream in the conveyance direction. As the leading end of the sheet P is conveyed downstream, the trailing end of the sheet P that is subsequently separated from the outlet cylinder 35 also moves smoothly in the conveyance direction of the conveyance belt 41 without moving in the circumferential direction of the drum 31 along with the rotation of the drum 31.

The duplex mechanism 60 includes a reverse path 61 and a duplex path 62. The reverse path 61 reverses the sheet P that has passed through the drying section 40 when the printing unit 70 performs duplex printing on the sheet P. The duplex path 62 feeds back the sheet P reversed in the reverse path 61 again to the loading path 301. The duplex mechanism 60 includes a plurality of conveyance roller pairs 601 in the reverse path 61 and the duplex path 62.

The ejection unit 50 includes an output tray 51 on which a plurality of sheets P is stacked. The plurality of sheets P conveyed from the drying section 40 are sequentially stacked and held on the output tray 51.

Next, a first conveyance path 111 according to the present embodiment will be described.

In the present embodiment, the inlet cylinder 34, the drum 31, the circumferential surface of the outlet cylinder 35, and the conveyance belt 41 constitute at least part of the first conveyance path 111.

In the present embodiment, the inlet cylinder 34 and the outlet cylinder 35 are connected via gears. A conveyance driving source provided with the drum 31 is used to drive the drum 31, the inlet cylinder 34, and the outlet cylinder 35 in conjunction with each other, so that the sheet P is conveyed through the first conveyance path 111. However, in other embodiments, the inlet cylinder 34, the drum 31, and the outlet cylinder 35 may include separate drive sources so that the drive sources of the inlet cylinder 34, the drum 31, and the outlet cylinder 35 drive the inlet cylinder 34, the drum 31, and the outlet cylinder 35 separately from each other.

Further, the driving source of the drive roller 401 that drives the conveyance belt 41 is a driving source independent of the driving source of the drum 31 and other components. However, the driving source of the drive roller 401 is controlled by the controller 80 so that the drive roller 401 be interlocked with the driving of, for example, the drum 31.

The driving sources of components along the first conveyance path 111 can be independently driven by an operation on an inching switch 81 as an inching operation device. Accordingly, even in a state where the image forming system 1 is stopped, the inlet cylinder 34, the drum 31, and the outlet cylinder 35 can be rotated (to perform an inching operation) by a predetermined operation on the inching switch 81.

The inching switch 81 is a switching device that switches "start (ON)" or "stop (OFF)" of the inching operation when a user performs a predetermined operation.

The predetermined operation on the inching switch 81 is an operation of pressing down the inching switch 81 as a first operation and releasing the inching switch 81 as a second operation. The first operation turns "ON" the inching switch 81, and the second operation turns "OFF" the inching switch 81. Note that the first operation and the second operation for the ON-OFF operation may be reversed. Alternatively, the first operation may be that the user touches the inching switch 81, and the second operation may be that the user does not touch the inching switch 81.

By the first operation to the inching switch 81, the drive roller 401 is also rotated in the same manner, and the conveyance belt 41 is rotated at the same speed as that of the inching operation, so that the sheet P can be conveyed downstream. Then, the drive roller 401 is stopped by the second operation.

The inching operation is a type of conveying operation and refers to an operation in which the sheet P is conveyed at a lower speed than in a normal printing operation, by a first operation on the inching switch 81. More specifically, only while the user performs the first operation of the inching switch 81, for example, the drum 31 is rotated at a speed lower than that during the printing operation. When the user performs the second operation on the inching switch 81, the rotation of the drum 31 is stopped. In the inching operation, the drum 31, the inlet cylinder 34, and the outlet cylinder 35 are driven in conjunction with each other. The drive roller 401 also operates in conjunction with the drum 31, the inlet cylinder 34, and the outlet cylinder 35.

Further, the inching operation not only rotates the drum 31 in the conveyance direction during the printing operation but also can select one of a forward rotation or a reverse rotation of the drum 31 by a rotation direction selector in the inching switch 81. Thus, the inching operation can be used to perform the removal process of the sheet P remaining on the circumferential surfaces of the drum 31, the inlet cylinder 34, and the outlet cylinder 35, the inspection and replacement of the sheet grippers 341, 311, and 351 during maintenance, the cleaning of the circumferential surface of the drum 31, and the cleaning and replacement of a plate of the drum 31 including the suction holes.

Further, the image forming system 1 includes a display 83 that displays the conveyance state of the sheet P. The display 83 is controlled by a display controller 813 described later. The state of the apparatus can be notified to the user through the display 83.

Next, a configuration of a second conveyance path 92 according to the present embodiment is described below.

The printing unit 70 includes a purge tray 91 below the drum 31 in an area between the inlet cylinder 34 and the outlet cylinder 35. The purge tray 91 is a purge ejection part to receive the sheet P during a purging operation. The second conveyance path 92 is directed diagonally downward from the receipt position "a" of the inlet cylinder 34 on an extension of the loading path 301. A conveyance roller pair 93 is disposed on the second conveyance path 92. The printing unit 70 further includes a purge ejection sensor 94 to detect the sheet P in the purge tray 91. The purge ejection sensor 94 can detect that a sheet P to be purged has been ejected to the purge tray 91.

The printing unit 70 includes a switching part 95 downstream from the receipt position "a" at which the inlet cylinder 34 receives the sheet P. The switching part 95 switches the conveyance path of the sheet P between the first conveyance path 111 and the second conveyance path 92. The switching part 95 includes a branching pawl 96 serving as a switching device. The switching part 95 switches the conveyance destination of the sheet P.

Further, the printing unit 70 includes a purge switch 82, which is an example of a purge operation device, to instruct the inlet cylinder 34 and the branching pawl 96 to eject the sheep P to the purge tray 91. Further, the reverse path 61 includes a reverse purge tray 97 (see FIG. 1).

Figure 3B:
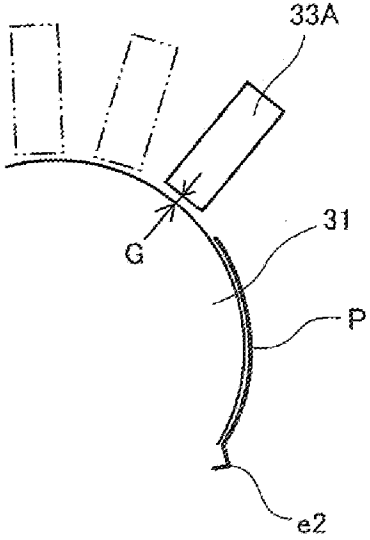
FIGS. 3A and 3B are a perspective view and a cross-sectional front view, respectively, of the drum of FIG. 2, illustrating a conveyance failure of a sheet.
Figure 3A:
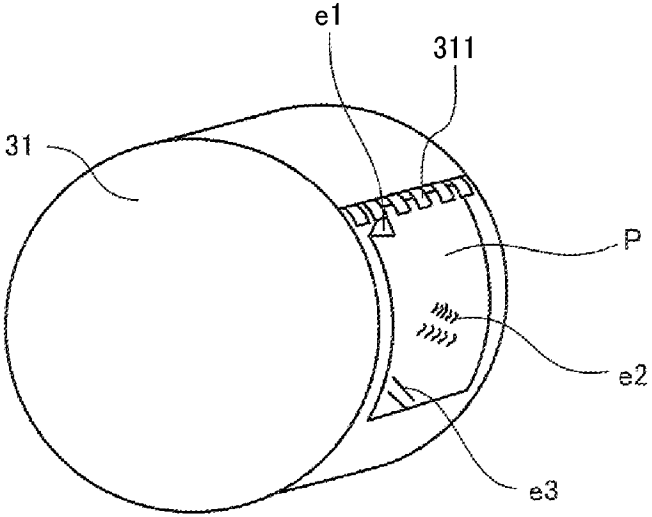

Next, a configuration of detection of a sheet in the first conveyance path 111 is described with reference to FIGS. 3A and 3B. FIGS. 3A and 3B are a schematic perspective view and a cross-sectional front view, respectively, of the drum 31 illustrating a conveyance failure of the sheet P.

The printing unit 70 includes a conveyance-failure detector 112 in the first conveyance path 111. The conveyance-failure detector 112 detects a displacement of the sheet P on the circumferential surface of the drum 31 in a thickness direction of the sheet P. As illustrated in FIG. 3A, the conveyance-failure detector 112 detects conveyance failures such as a floating e3, wrinkles e2, and a corner fold e1 of the sheet P. Note that the term "conveyance failure" used herein does not mean a state in which conveyance is actually disabled, but means a state in which a sheet causes a conveyance failure.

If the posture of the sheet P is tilted when the sheet P is attracted to the drum 31, the leading end of the sheet P comes off from the sheet gripper 311 to cause the corner fold e3, the floating e1, or the wrinkles e2.

When the sheet P in the above-described state enters a gap G between the circumferential surface of the drum 31 and the discharge unit 33A as illustrated in FIG. 3B, the sheet P might interfere (collide) with the discharge unit 33A and damage a liquid discharge head of the discharge unit 33A.

For this reason, the printing unit 70 stops driving the drum 31 and the conveyance of the sheet P before the sheet P enters the gap G between the circumferential surface of the drum 31 and the liquid discharge head of the discharge unit 33A most upstream in the conveyance direction when the conveyance-failure detector 112 detects the conveyance failure on the drum 31.

Further, the printing unit 70 includes a first sensor 113 and a second sensor 114 that constitute at least part of a sheet detector 115 to detect the sheet P in the switching part 95.

The first sensor 113 is disposed upstream from the switching part 95 in the conveyance direction. In the present embodiment, the first sensor 113 is disposed upstream from the inlet cylinder 34 at a position at which the first sensor 113 can detect the sheet P on the loading path 301.

The second sensor 114 is disposed downstream from the switching part 95 in the conveyance direction. In the present embodiment, the second sensor 114 is disposed at a position at which the second sensor 114 can detect the sheet P on the circumferential surface of the inlet cylinder 34.

The sheet P is at the switching part 95 when both the first sensor 113 and the second sensor 114 detect the sheet P.

Detailed Description of Controller 80

Figure 4:
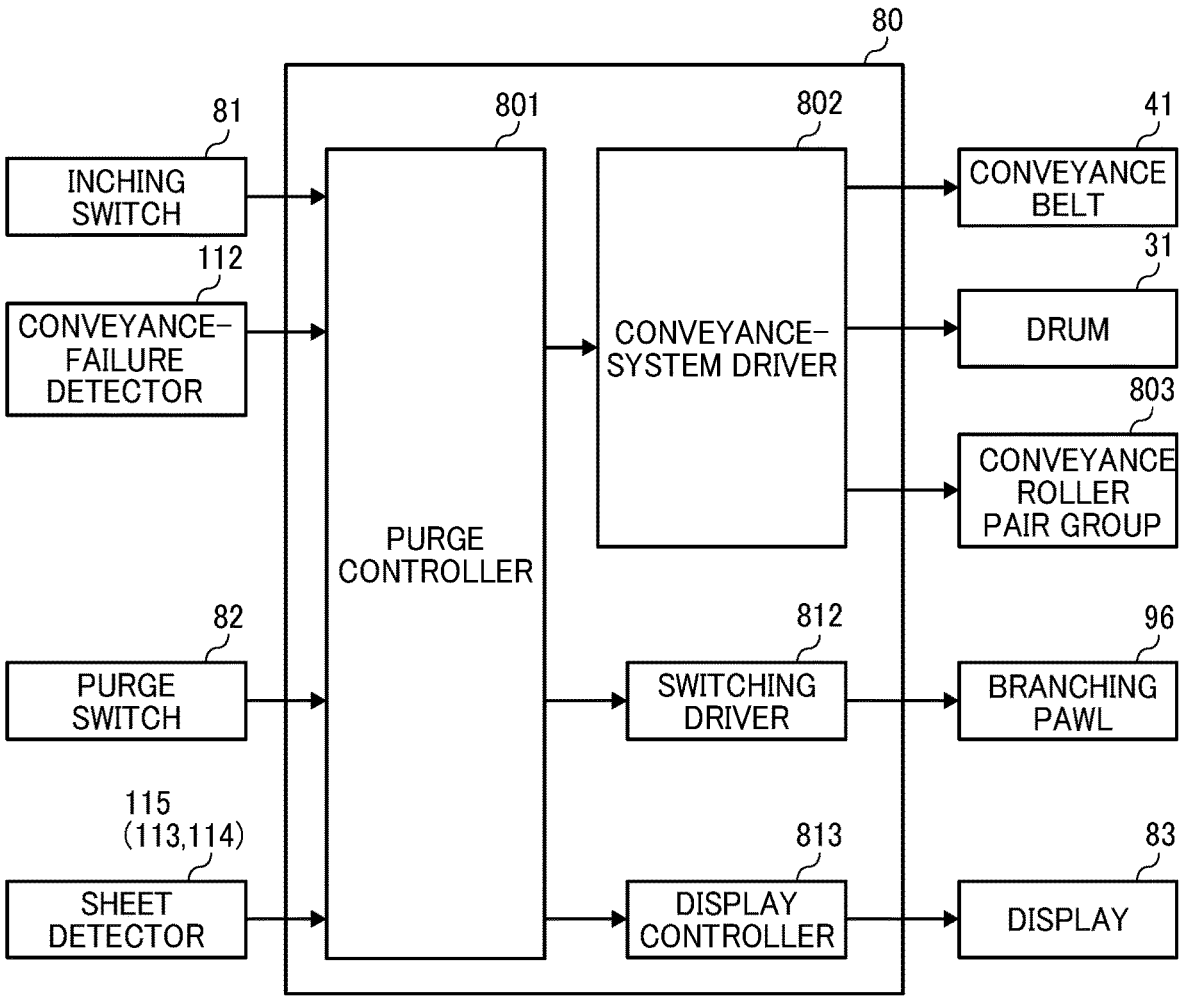
FIG. 4 is a block diagram illustrating a controller that controls an inching operation and a purge operation, according to an embodiment of the present disclosure.

Next, the controller 80 that controls the purge operation is described with reference to the functional block diagram of FIG. 4. The purge operation is an operation for removing a remaining sheet from a conveyance path and returning the conveyance path to a normal state when a sheet P is in a conveyance failure.

The controller 80 controls the entire operation of the image forming system 1. Hereinafter, a configuration that mainly controls the purge operation is described below. As an example, the controller 80 includes a purge controller 801, a conveyance-system driver 802, a display controller 811 as a display controller, and a switching driver 812.

The purge controller 801 controls the purge operation and also controls switching the conveyance path of the sheet P between the first conveyance path 111 and the second conveyance path 92 in the switching part 95.

When the conveyance-failure detector 112 defects a conveyance failure, the purge controller 801 stops operations of the drum 31, the conveyance belt 41, and the conveyance roller pair group 803 such as the conveyance roller pairs 302 and 601 via the conveyance-system driver 802 to stop the conveying operation of the sheet P.

When the purge controller 801 receives, as an inching controller, a predetermined operation on the inching switch 81, the purge controller 801 controls execution of the inching operation. The predetermined operation is, for example, an operation in which the user presses the inching switch 81. That is, while the inching switch 81 is being pressed, the inching operation for driving the drum 31 and the inlet cylinder 34 and the outlet cylinder 35, which are driven by the drum 31, is controlled via the conveyance-system driver 802. In addition, while the inching switch 81 is being pressed, the purge controller 801 serving as an inching device drives the drive roller 401 in conjunction with the driving of, for example, the drum 31 to move the conveyance belt 41 serving as a conveyor at a predetermined speed. The rotation speed of the drive roller 401 that drives the conveyance belt 41 is set to be the same as or higher than the rotation speed of the outlet cylinder 35. That is, the conveying speed of the sheet P by the conveyance belt 41 is set to be higher than the rotation speed of the outlet cylinder 35 during the inching operation.

When the purge controller 801 receives an instruction of a purge operation from the purge switch 82, the purge controller 801 controls the display 83 to notify the user to perform the inching operation when the sheet detector 115 (the first sensor 113 and the second sensor 114) detects the sheet P in the switching part 95.

When the purge controller 801 receives the instruction of the purge operation from the purge switch 82, the sheet detector 115 (first sensor 113 and second sensor 114) detects absence of the sheet P in the switching part 95 and then the purge controller 801 controls the switch driver 812 to drive the branching pawl 96 to change the conveyance path of the sheet P from the first conveyance path 111 to the second conveyance path 92.

When the conveyance operation is stopped based on the detection of the conveyance failure, the purge controller 801 controls the conveyance-system driver 802 and the switch driver 812 to perform operations such as the ejection of a remaining sheet P to the ejection unit 50, the ejection of the remaining sheet P to the reverse purge tray 97, and the ejection of the remaining sheet P to the purge tray 91.

Figure 5:
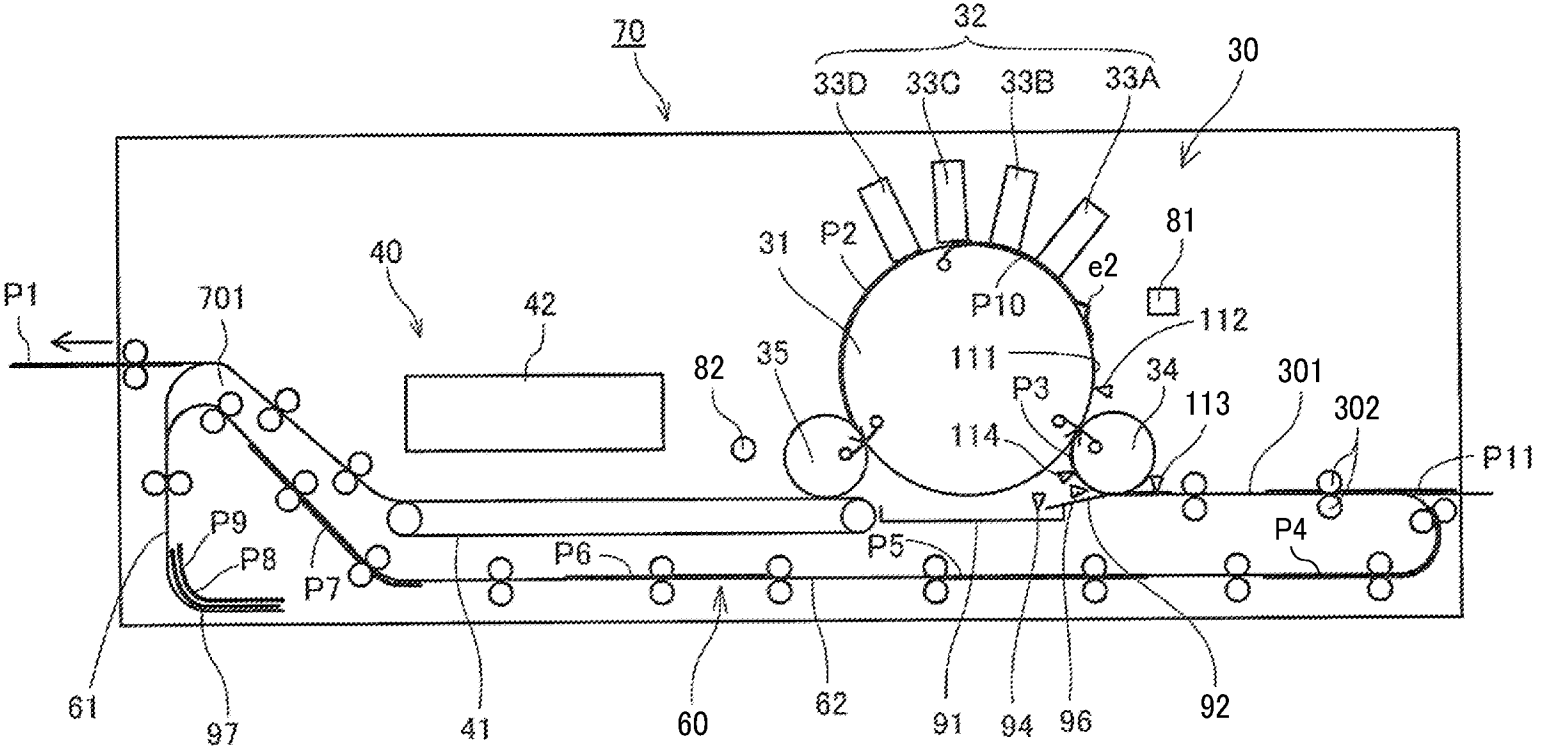
FIG. 5 is a schematic view of a printing unit illustrating an example of the positions of sheets remaining in the liquid discharge apparatus when a conveyance operation is stopped.

Next, an example of a state of the printing unit 70 in the image forming system 1 when the conveyance operation is stopped by the conveyance failure is described with reference to FIG. 5. FIG. 5 is a schematic cross-sectional front view of the printing unit 70 illustrating an example of a position of the sheet P remaining in the printing unit 70 when the conveying operation is stopped.

In FIG. 5, the conveyance-failure detector 112 detects a conveyance failure of a floating e2 on a trailing end of a sheet P10 on the first conveyance path 111.

When the conveyance-failure detector 112 detects an occurrence of a conveyance failure of the sheet P, the purge controller 801 immediately stops the rotational driving of the drum 31 to prevent a portion of the floating e2 of the sheet P from entering the gap G between the drum 31 and the discharge unit 33.

However, a certain constant distance is necessary as a brake distance due to inertial force of the drum 31, the inlet cylinder 34, and the outlet cylinder 35. Accordingly, a sheet P that causes the conveyance failure stops at a position slightly advanced from the conveyance-failure detector 112. For this reason, the distance between the conveyance-failure detector 112 to the head of the discharge unit 33 is set to be equal to or larger than the above-described brake distance.

On the other hand, the purge controller 801 conveys to the ejection unit 50 a sheet P1, onto which printing of an image has been normally finished, among sheets P remaining in the drying section 40, the ejection path 701, and the duplex mechanism 60. The purge controller 801 conveys a sheet P8 and a sheet P9, the back side (second side) of each of which has not been printed, to the reverse purge tray 97 (serving as the second purge tray) below the reverse path 61. The purge controller 801 stops, at the current positions, sheets P7, P6, P5, P4, and P11 remaining in a path from the duplex path 62 to the loading path 301.

Further, a nozzle surface of the head of the discharge unit 33 is capped by the cap 38 (see FIG. 2) after the discharge unit 33 moves upward. Thus, the head is not damaged by the sheet P even if the sheet P enters the gap G (see FIG. 3B) between the discharge unit 33 and the drum 31.

After the above-described processes end, the purge controller 801 causes the display controller 813 to display the positions of the remaining sheets P and a state of jam on the display 83 to notify the user.

Detailed Example of Inching Operation

Figure 6:
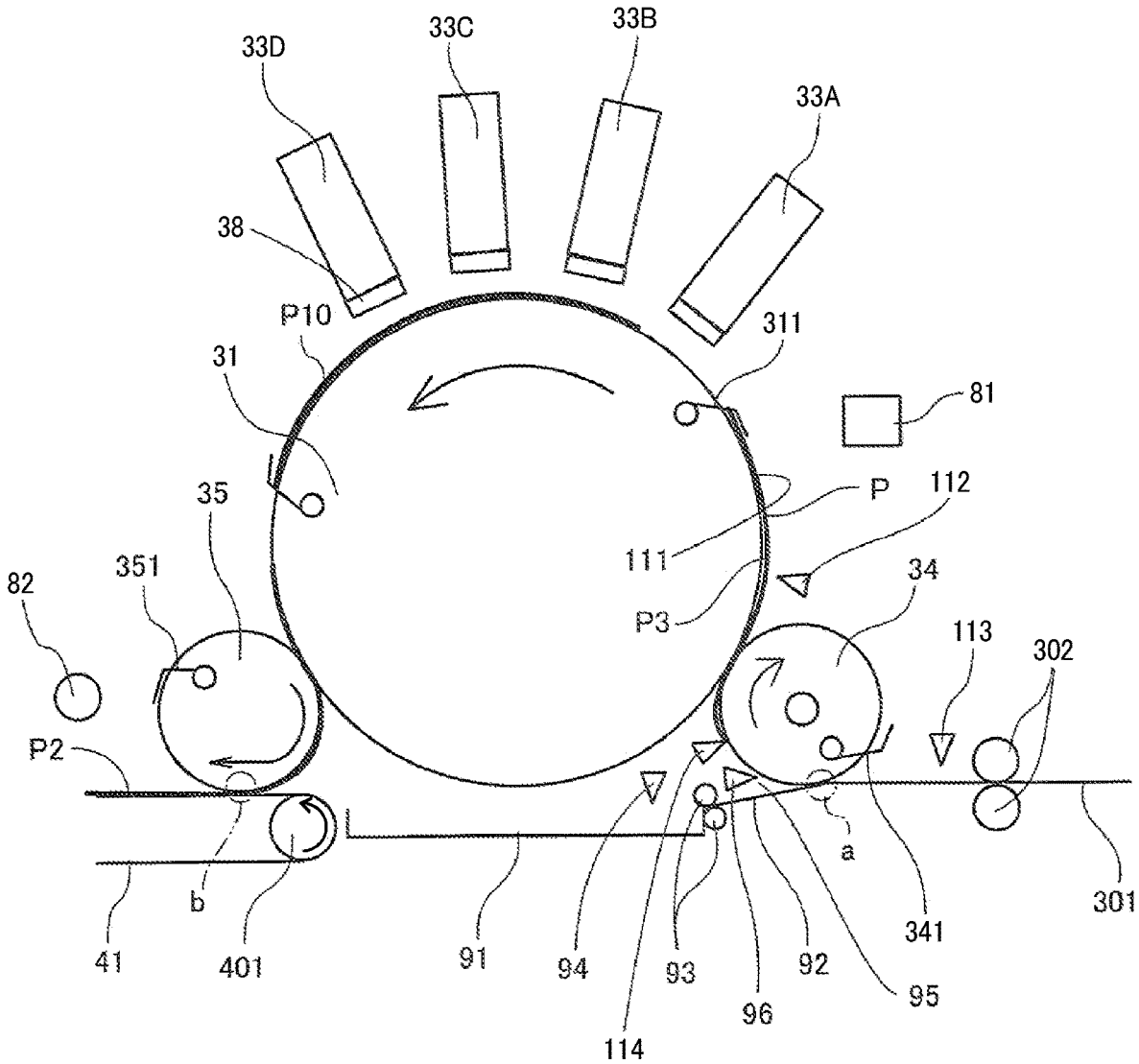
FIG. 6 is an enlarged view of the printing unit, illustrating an inching operation.
Figure 7:
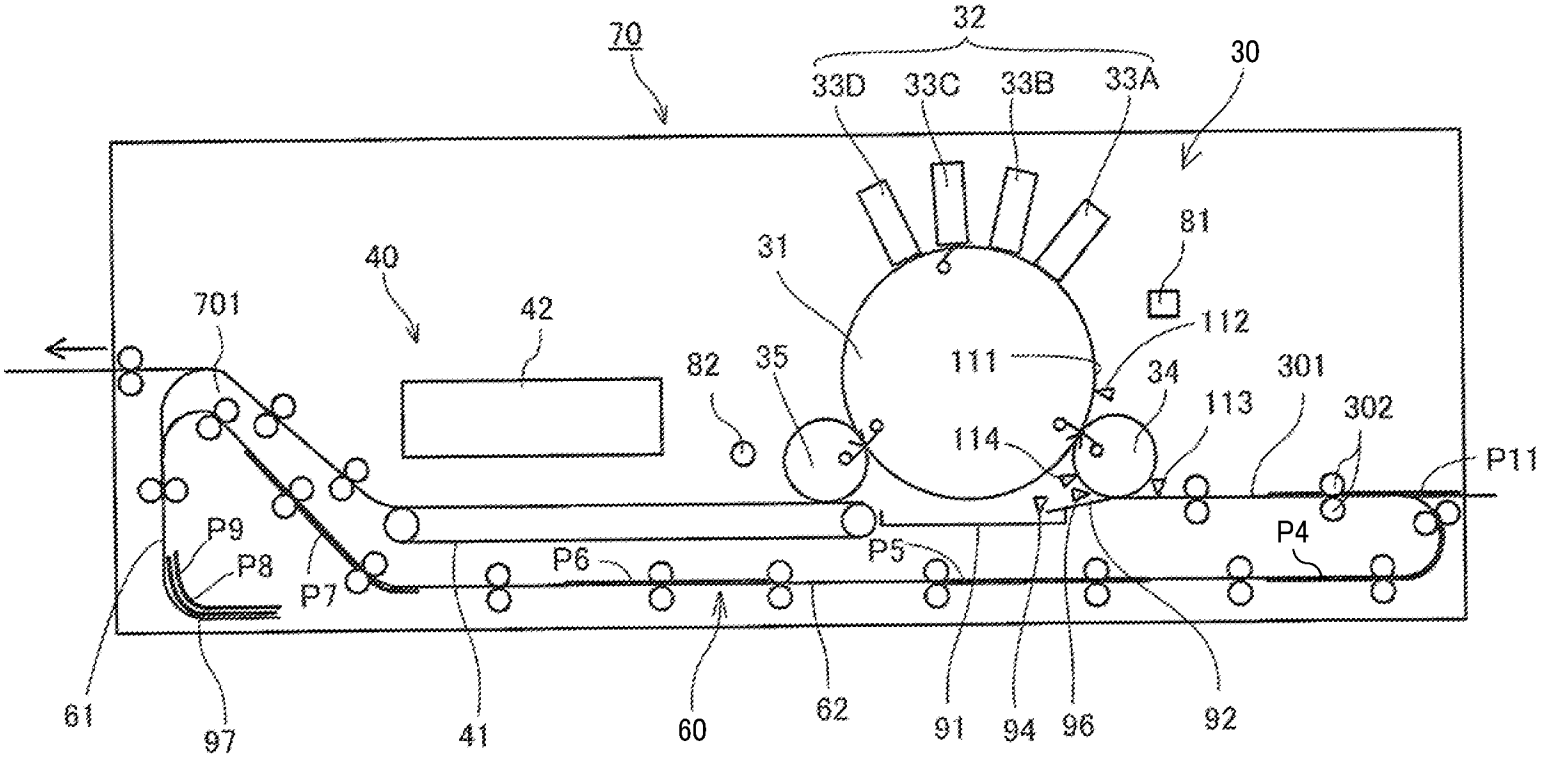
FIG. 7 is a cross-sectional front view of the printing unit, illustrating a state after the inching operation.

Next, a removal process of the sheet P remained in the first conveyance path 111 is described with reference to FIGS. 6 and 7. FIG. 6 is a cross-sectional front view of the printing unit 70 illustrating an inching operation. FIG. 7 is a cross-sectional front view of the printing unit 70 illustrating a state of the printing unit 70 after the inching operation.

When the conveyance-failure detector 112 detects a conveyance failure, the purge controller 801 stops conveyance of a sheet P as described above. For example, a sheet P3 is stopped at a position across the switching part 95 as illustrated in FIG. 6. Accordingly, if an attempt is made to convey a sheet P11 on the loading path 301 and sheets P4 to P7 on the duplex path 62 to the purge tray 91, the sheets would collide with the sheet P3, thus causing a jam.

Therefore, the inching switch 81 is used to perform a removal process of a sheet P remaining on the first conveyance path 111. The circumferential surfaces of the inlet cylinder 34, the drum 31, and the outlet cylinder 35 constitute at least part of the first conveyance path 111.

A second conveyance path 92 leading to the purge tray 91 is arranged on the extension of the loading path 301 so that sheets P on the loading path 301 and the duplex path 62 can be conveyed to the purge tray 91 below the drum 31.

When the sheets P are stopped in the state illustrated in FIG. 5 described above, the inching switch 81 is operated. As illustrated in FIG. 6, the inlet cylinder 34, the drum 31, the outlet cylinder 35, and the drive roller 401 rotate in the directions indicated by the arrows in FIG. 6 to perform the inching operation.

Accordingly, even in a state where the leading end of the sheet P2 is fed to the conveyance belt 41 and the trailing end of the sheet P2 remains on the drum 31, sheets are sequentially fed onto the conveyance belt 41 by the rotation of the drive roller 401 that rotates in conjunction with the rotation of the drum 31 by the inching operation.

The same applies to the sheet P10 following the sheet P2. Even when the leading end of the sheet P10 is fed out from the outlet cylinder 35 to the conveyance belt 41 by the inching operation, the leading end of the sheet P10 is conveyed downstream by the conveyance belt 41 when the inching operation is performed. Such a configuration can restrain the leading end of the sheet P10 from being caught by the rotation of the drum 31 when the trailing end of the sheet P10 separates from the drum 31 and is transferred to the outlet cylinder 35. The same applies to the sheet P3 following the sheet P10.

Thus, the sheet P2, the sheet P10, and the sheet P3 are sequentially moved to the conveyance belt 41 of the drying section 40 as illustrated in FIG. 7 and removed from the first conveyance path 111. Thus, all the sheets P across the switching part 95 can be removed.

Then, an operation of the purge switch 82 switches the branching pawl 96 of the switching part 95 from the first conveyance path 111 to the second conveyance path 92. Further, a subsequent purge operation ejects the sheet P11 on the loading path 301 and the sheets P4 to P7 on the duplex path 62 to the purge tray 91.

Figure 11:
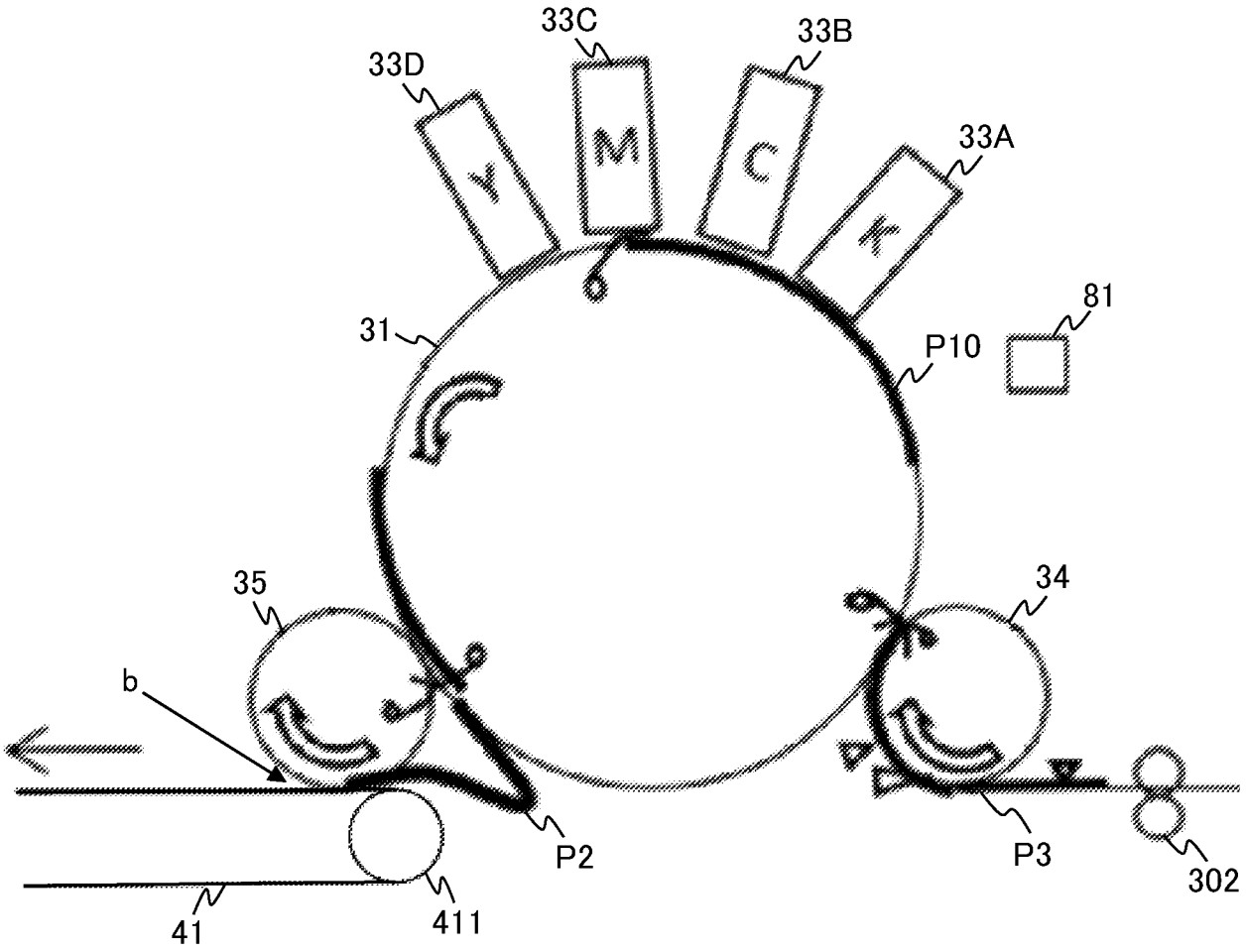
FIG. 11 is an enlarged view of a printing unit according to a comparative example, illustrating an inching operation.

A description is given below of an advantageous effect of performing the inching operation when a conveyance failure occurs as described above. FIG. 11 illustrates a time point slightly before the state illustrated in FIG. 6, and assumes a state in which the drive roller 401 is not rotated in the inching operation or is not interlocked with the inching operation of the drum 31.

When the sheet P is fed by the inching operation, the trailing end of the sheet P may be dragged to the drum 31 while the sheet P is being fed downstream from the outlet cylinder 35, depending on the thickness, rigidity, and surface properties of the sheet P. That is, like the sheet P2, in a case where the leading end is near the transfer position and the trailing end is on the drum 31 when the sheet P2 is stopped due to a conveyance failure, the sheet P2 is likely to be slack on the outlet cylinder 35.

In the subsequent inching operation, "dragging" is likely to occur on the trailing end of the sheet P2 in the circumferential surface direction of the drum 31 along with the rotation of the drum 31. Then, if the inching operation is continued as it is, the sheet P2 may be entangled with the drum 31, or an unfixed image formed by the liquid adhering to the sheet P2 may be rubbed against another component in the apparatus, thus causing contamination inside the apparatus or image disturbance.

For this reason, as in the printing unit 70 according to the present embodiment, the conveyance belt 41 that is disposed downstream from the transfer position b in the conveyance direction of the sheet P constitutes at least part of a downstream conveyor. When the inching switch 81 is manually operated to rotate and drive the inlet cylinder 34, the drum 31, and the outlet cylinder 35 to perform the inching operation, the drive roller 401 serving as a conveyor is further driven to synchronize the conveyance of the sheet P by the conveyance belt 41 with the conveyance of, for example, the drum 31.

With the above-described configuration, the leading end of the sheet P2 is fed in the downstream direction from the transfer position b by the conveyance belt 41 serving as a conveyor along with the inching operation. As a result, the slack of the sheet P2 on the outlet cylinder 35 is eliminated, and the sheet P2 is prevented from being wound around the drum 31.

Instead of the conveyance belt 41, in other embodiments, a pair of conveying rollers may be used as the conveyor of the printing unit 70 to nip and convey the sheet P.

Figure 8:
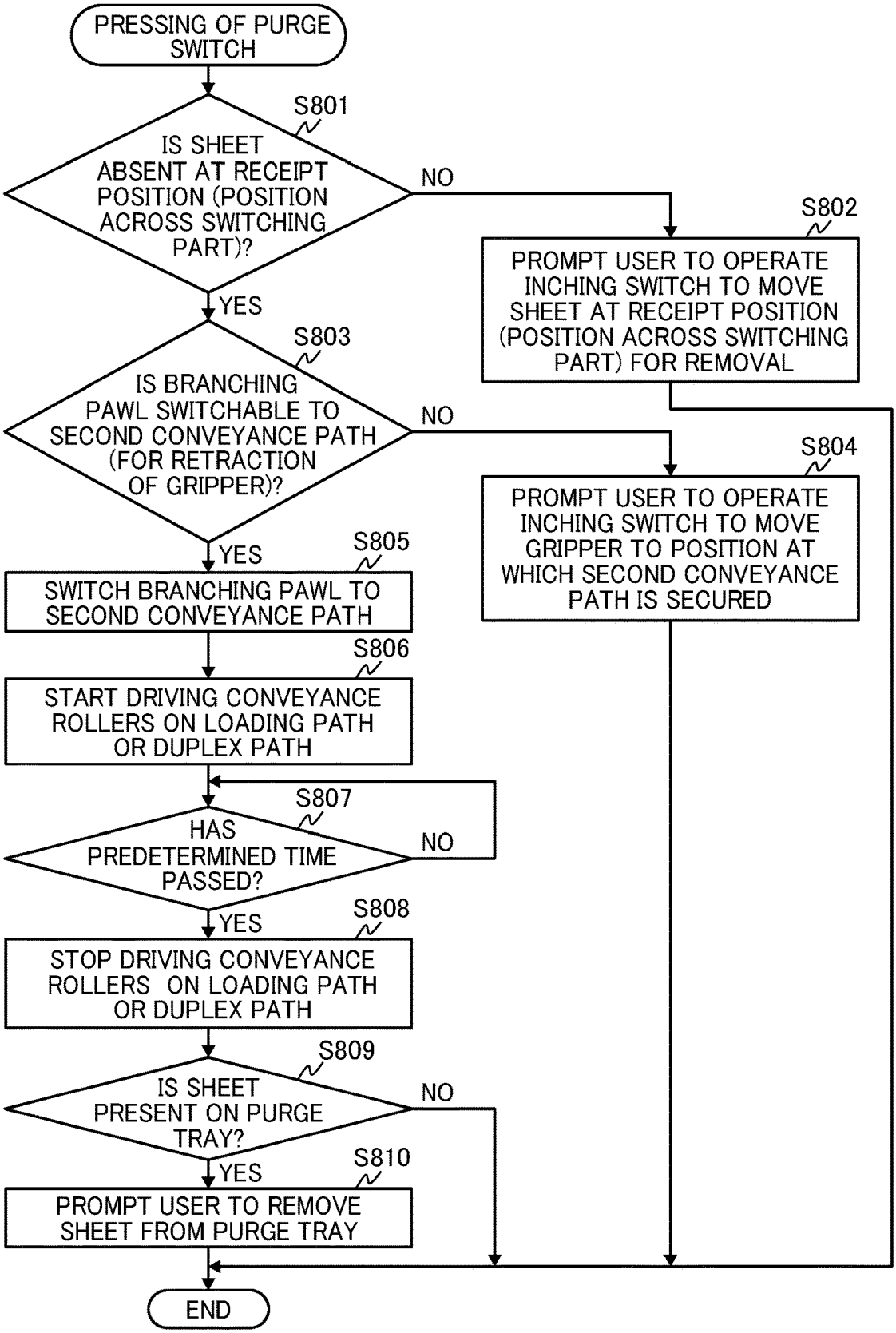
FIG. 8 is a flowchart illustrating a flow of a control process of a purge operation, according to an embodiment of the present disclosure.
Figure 9:
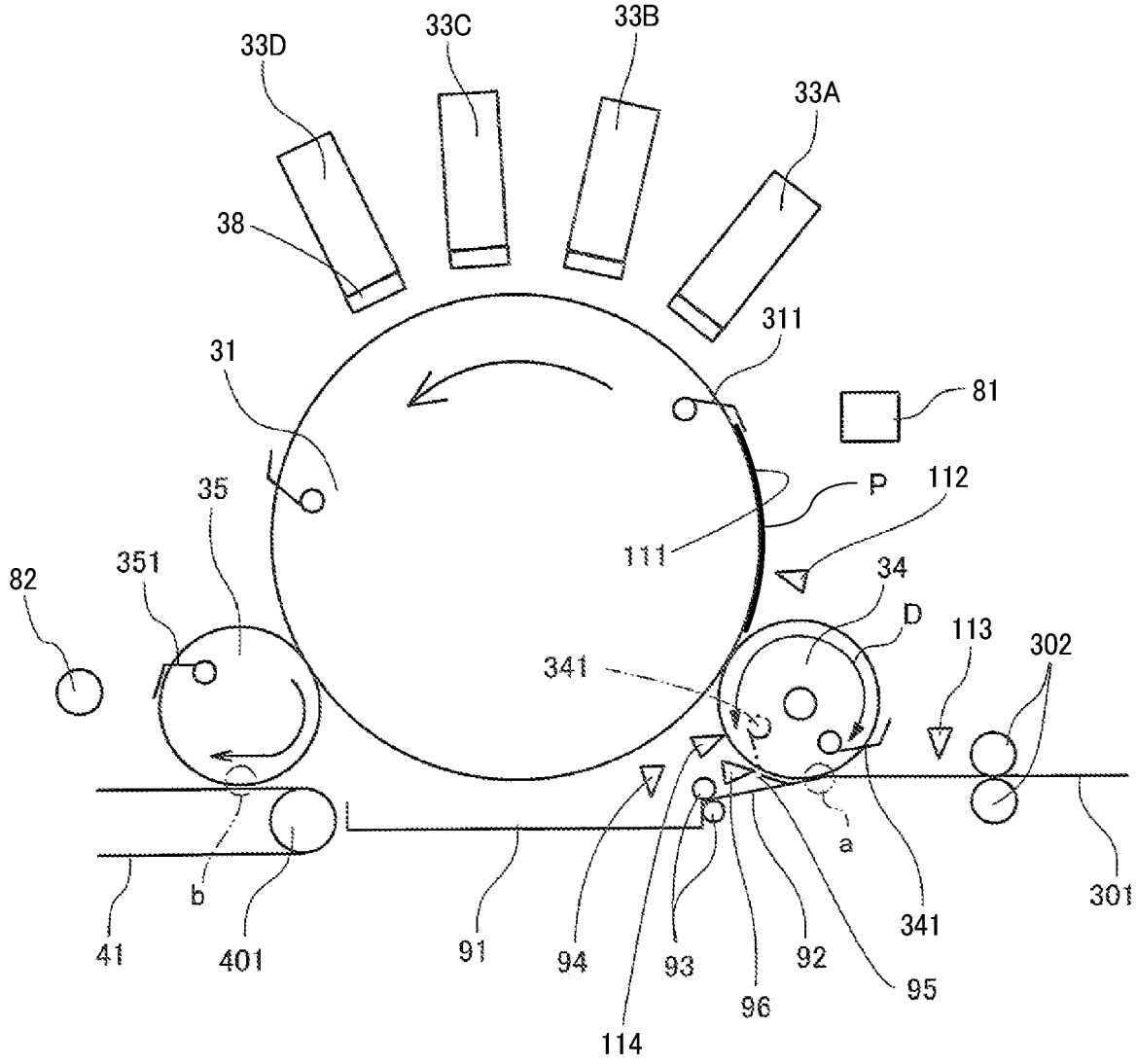
FIG. 9 is an enlarged cross-sectional front view of the printing unit illustrating an example of a state of the printing unit in which the purge switch is pressed.

Next, control of the purge operation is described with reference to FIGS. 8 and 9. FIG. 8 is a flowchart of the control of the purge operation. FIG. 9 is a cross-sectional front view of the printing unit 70 illustrating an example of a state of the printing unit 70 in which the purge switch 82 is pressed.

When the purge switch 82 is pressed, the purge controller 801 determines whether the sheet P is absent across the switching part 95 (step S801) from detection results of the sheet detector 115 (including the first sensor 113 and the second sensor 114). Specifically, the purge controller 801 determines whether the sheet P is absent at the receipt position "a". In FIG. 8, the receipt position "a" is simply referred to as "receipt position." The receipt position "a" is adjacent to the switching part 95.

If a sheet P is present across the receipt position "a" (switching part 95) (NO in S801), the purge controller 801 causes the display 83 to display that the sheet P across the receipt position "a" (switching part 95) need be removed by the inching operation, to notify the user.

Conversely, if there is no sheet P across the receipt position "a" (switching part 95) (YES in S801), the purge controller 801 determines whether the branching pawl 96 is switchable from the first conveyance path 111 to the second conveyance path 92 (S803).

That is, as illustrated in FIG. 9, if the sheet gripper 341 of the inlet cylinder 34 is at the receipt position "a" (switching part 95) when the purge switch 82 is pressed, the second conveyance path 92 would be blocked by the sheet gripper 341. For this reason, the purge controller 801 causes the sheet gripper 341 to move to a position at which the sheet gripper 341 of the inlet cylinder 34 opens the second conveyance path 92 (does not block the second conveyance path 92).

The purge controller 801 detects that the sheet gripper 341 of the inlet cylinder 34 is at a retracted position by a reflective sensor. The purge controller 801 may detect the phase of the rotation angle of the inlet cylinder 34 and the drum 31 to detect the position of the sheet gripper 341.

When the branching pawl 96 is not switchable from the first conveyance path 111 to the second conveyance path 92 (NO in S803), the purge controller 801 causes the display 83 to display that the sheet gripper 341 need be moved to the retracted position by the inching operation, to notify the user (S804).

Conversely, when the branching pawl 96 is switchable to the second conveyance path 92 (YES in S803), the purge controller 801 switches the branching pawl 96 from the first conveyance path 111 to the second conveyance path 92 (S805).

Then, the purge controller 801 starts driving the conveyance roller pair 302 of the loading path 301 and the conveyance roller pair 601 of the duplex path 62 (S806). Thus, for example, the sheets P11, P4, P5, P6, and P7 are conveyed to and collected onto the purge tray 91.

The purge controller 801 determines whether a specified time has elapsed (YES in S807). When the specified time has elapsed (YES in S807), the purge controller 801 ends driving of the conveyance roller pair 302 of the loading path 301 and the conveyance roller pair 601 of the duplex path 62 to stops the conveyance roller pair 302 and the conveyance roller pair 601 (S808).

Then, the purge controller 801 determines whether a sheet P stored in the purge tray 91 is present (S809). When a sheet P stored in the purge tray 91 is present (YES in S809), the purge controller 801 notifies and prompts the user to remove the sheet P from the purge tray 91 (S810).

As described above, the purge controller 801 controls the branching pawl 96 to switch from the first conveyance path 111 to the second conveyance path 92 after the sheet detector 115 detects the absence of sheet P. Such a configuration can prevent the occurrence of a jam during the removal process of the remaining sheet P to restrain a decrease in productivity of the printing operation.

If the sheet P extending from the drum 31 to the outlet cylinder 35 is present during the inching operation when the purge operation is performed, the drive roller 401 serving as a downstream conveyor is also operated in conjunction with the inching operation. Such a configuration, as described above, can prevent the sheet P in the vicinity of the transfer position b from being dragged by the rotation of the drum 31 during the inching operation and being wound around the drum 31 near the purge tray 91. Thus, the removal performance of the remaining sheet can be enhanced.

Figure 10:
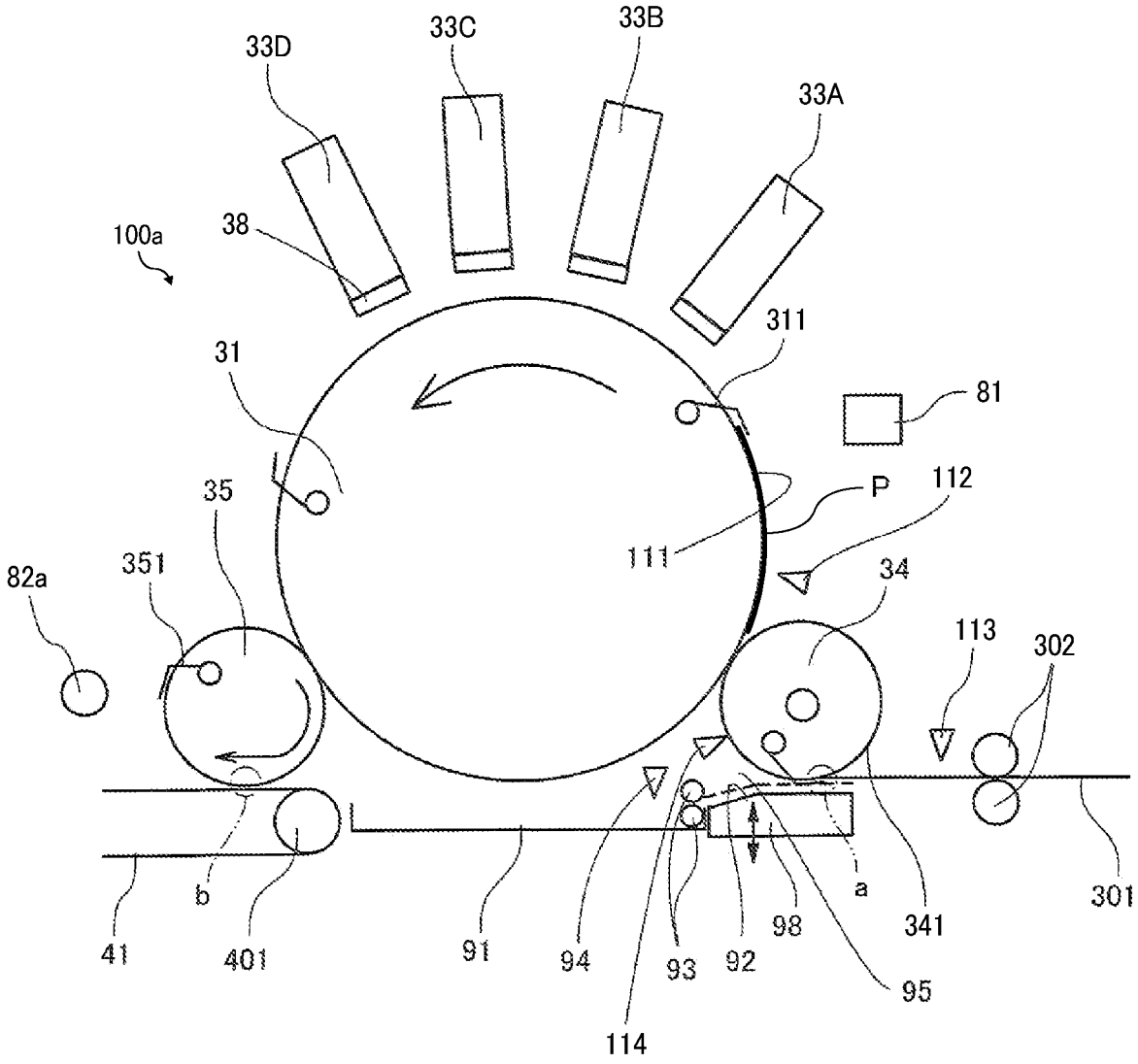
FIG. 10 is an enlarged view of a conveying device according to a second embodiment of the present disclosure, illustrating a state of a conveying device in which a purge switch is pressed.

A second embodiment of the present disclosure is described with reference to FIG. 10. FIG. 10 is a schematic view of a printing unit 70 of a drum-type conveying device 100*a* according to the second embodiment, illustrating a state in which a purge switch 82*a* is pressed.

The printing unit 70 in the second embodiment includes a vertical moving part 98 constituting part of a second conveyance path 92. The vertical moving part 98 is a movable member that reciprocates (advances and retracts) between a first position indicated by a broken line in FIG. 10 and a second position indicated by a solid line in FIG. 10 with respect to the inlet cylinder 34. The vertical moving part 98 is also referred to as a "reciprocating part".

The vertical moving part 98 is movable between the first position and the second position. At the first position, a gap between the circumferential surface of the inlet cylinder 34 and the vertical moving part 98 is about 1 mm. At the second position, the gap between the circumferential surface of the inlet cylinder 34 and the vertical moving part 98 is about 3 to 10 mm. Further, the sheet P is guided to the first conveyance path 111 when the vertical moving part 98 is at the first position, and the sheet P is guided to the second conveyance path 92 when the vertical moving part 98 is at the second position.

When the purge switch 82 is pressed, the vertical moving part 98 moves downward to the second position at which the vertical moving part 98 is away from the circumferential surface of the inlet cylinder 34 as illustrated in FIG. 10. Thus, the sheet P falls down onto the second conveyance path 92 by its own weight and is guided to the second conveyance path 92.

Thus, the second conveyance path 92 is lowered to a position at which the conveyance of a sheet P on the second conveyance path 92 is not affected by the sheet gripper 341 of the inlet cylinder 34. Even when the gripper 341 is at the receipt position "a", the sheet P is movable along the second conveyance path 92 by its own weight.

Thus, the printing unit 70 in the second embodiment includes the vertical moving part 98 that constitutes at least part of a switching part to switch between the first conveyance path 111 and the second conveyance path 92.

Therefore, in the flowchart of FIG. 8 according to the first embodiment, instead of step S805 in which the branching pawl 96 is switched from the first conveyance path 111 to the second conveyance path 92, the purge controller 801 according to the second embodiment causes the vertical moving part 98 to move downward to the second position when the purge switch 82 is pressed. Such a configuration obviates the operation of moving the gripper 341 to the retracted position.

Thus, the vertical moving part 98 can further reduce the downtime during the printing operation.

Further, also in the present embodiment, if a sheet P extending from the drum 31 to the outlet cylinder 35 is present when the inching switch 81 is operated to perform the inching operation similarly to the first embodiment, the drive roller 401 serving as the downstream conveyor is also operated in conjunction with the inching operation. Such a configuration, as described above, can prevent the sheet P in the vicinity of the transfer position b from being dragged by the rotation of the drum 31 during the inching operation and being wound around the drum 31 near the purge tray 91. Thus, the removal performance of the remaining sheet can be enhanced.

The invention according to the present application described above has been made to further improve the preceding invention that has been already made by the applicant of the present application in view of a problem of the related art. In the preceding invention of the applicant, when the conveyance of a sheet is stopped due to occurrence of a conveyance failure, a remaining sheet on a cylinder or a drum is fed by a desired distance only during execution of a predetermined operation by a user, to solve the problem of the related art. The preceding invention of the applicant can facilitate the removal of the remaining sheet and restrain a decrease in productivity. However, as described above, the inventors of the present application have examined further improvement.

As a result, the inventors of the present application have found that the leading end of a sheet gripped by the rotary conveyor is finally released from the gripper, and the sheet is sent to, for example, a conveyance path to a downstream fixing portion. That is, when the sheet is fed downstream of the conveyance rotating body by the inching operation, a rear end portion of the sheet may be dragged toward the conveyance rotating body depending on the thickness, rigidity, or surface properties of the sheet.

In particular, when the sheet stops due to a conveyance failure, the leading end of the sheet may be located near a transfer position from the rotary conveyor to the downstream conveyance path while the trailing end of the sheet is located on the rotary conveyor. In such a case, the sheet is likely to sag at an outlet rotary body that feeds the leading end of the sheet from the rotary conveyor to the downstream conveyance path. Even if an attempt is made to feed the sheet to the downstream side by the inching operation in a state in which slack has occurred in the sheet, the rear end of the sheet is likely to be dragged along with the rotation of the rotary conveyor.

Such dragging of the sheet may cause problems that the sheet is entangled with the rotary conveyor, an unfixed image is rubbed against components in the apparatus to cause a disturbed image, and an unfixed liquid is adhered to the inside of the apparatus to stain the apparatus.

Hence, the invention of the present application has been made as a result of further study on the preceding invention that can solve the above-described problem of the related art. That is, the performance of removing the remaining sheet caused by the conveyance failure can be enhanced, thus preventing liquid that has not been fixed in the remaining sheet from adhering to and contaminating the structure of the apparatus.

The present disclosure is not limited to specific embodiments described above, and numerous additional modifications and variations are possible in light of the teachings within the technical scope of the appended claims. It is therefore to be understood that the disclosure of the present specification may be practiced otherwise by those skilled in the art than as specifically described herein. Such embodiments and variations thereof are included in the scope and gist of the embodiments of the present disclosure and are included in the embodiments described in claims and the equivalent scope thereof.

The functions of the above-described embodiments may be implemented by one or a plurality of processing circuits. Here, the processing circuit or circuitry in the present specification includes a programmed processor to execute each function by software, such as a processor implemented by an electronic circuit, and devices, such as an application specific integrated circuit (ASIC), a digital signal processor (DSP), and a field programmable gate array (FPGA), and conventional circuit modules arranged to perform the recited functions.

The invention claimed is:

1. A conveying device, comprising:

a rotating carrier configured to carry a sheet;

an inlet rotary body configured to transfer the sheet to the rotating carrier from upstream of the rotating carrier in a conveyance direction of the sheet;

an outlet rotary body configured to transfer the sheet to a downstream area from the rotating carrier in the conveyance direction;

a downstream conveyor configured to convey the sheet downstream from the outlet rotary body in the conveyance direction;

a purge ejection part disposed in vicinity of the inlet rotary body and configured to receive the sheet;

a conveyance-failure detector configured to detect a conveyance failure of the sheet on a conveyance path on which the sheet is conveyed;

a switching part disposed on an upstream side of the conveyance-failure detector in the direction of conveyance of the sheet and configured to switch a conveyance destination of the sheet between the conveyance path and the purge ejection part; and an inching controller configured to perform an inching operation to convey the sheet on a conveyance path including at least the downstream conveyor, the inching controller being configured to cause at least the outlet rotary body and the downstream conveyor to perform a conveying operation in conjunction with each other in the inching operation.

2. The conveying device according to claim 1, further comprising an inching operation device configured to instruct the inching operation;

wherein the inching controller is configured to cause at least the outlet rotary body and the downstream conveyor to perform the conveying operation while a first operation is performed on the inching operation device, and wherein the inching controller is configured to cause at least the outlet rotary body and the downstream conveyor to stop the conveying operation while a second operation is performed on the inching operation device.

3. The conveying device according to claim 1, further comprising:

a display configured to display a conveyance state of the sheet; and a controller configured to stop conveyance of the sheet, wherein the controller is configured to: stop conveyance of the sheet when the conveyance failure is detected; and cause the display to display information instructing the inching operation.

4. The conveying device according to claim 3, further comprising:

wherein the controller is configured to switch, to the purge ejection part, the conveyance destination of the sheet being upstream from the inlet rotary body in the conveyance direction in response to a detection of the conveyance failure with the conveyance-failure detector.

5. The conveying device according to claim 4, further comprising:

a purge controller configured to control a purge operation to eject the sheet on the conveyance path to the purge ejection part; and a purge operation device configured to instruct the purge operation, wherein the purge controller is configured to switch the conveyance direction of the sheet to eject the sheet to the purge ejection part.

6. The conveying device according to claim 1, wherein a conveying speed of the sheet by the downstream conveyor is higher than a conveying speed of the sheet by the outlet rotary body during the inching operation.

7. A liquid discharge apparatus, comprising:

the conveying device according to claim 1 configured to convey the sheet; and a liquid discharge device configured to discharge liquid onto the sheet conveyed by the conveying device.

* * * * *